United States Patent [19]

McIver

[11] Patent Number: 5,033,690

[45] Date of Patent: Jul. 23, 1991

[54] HOSE ROLLING APPARATUS

[76] Inventor: James McIver, 2441 E. A St., Torrington, Wyo. 82240

[21] Appl. No.: 494,775

[22] Filed: Mar. 16, 1990

[51] Int. Cl.[5] ..... B65H 75/00

[52] U.S. Cl. ..... 242/86; 242/106

[58] Field of Search ..... 242/86, 86.1, 86.5 R, 242/86.52, 96, 106

[56] References Cited

U.S. PATENT DOCUMENTS

| | | | |
|---|---|---|---|
| 2,045,966 | 6/1936 | Ruehmann | 242/86.1 |
| 2,869,800 | 1/1959 | Eden | 242/86 |
| 3,946,964 | 3/1976 | Zinser | 242/86 |
| 4,390,141 | 6/1983 | Webster | 242/86.5 R |
| 4,592,519 | 6/1986 | Peacock | 242/86 |
| 4,611,645 | 9/1986 | Whisnant | 242/86.5 R |
| 4,732,345 | 3/1988 | Golden | 242/86 |

*Primary Examiner*—John M. Jillions

*Attorney, Agent, or Firm*—Dean P. Edmundson

[57] ABSTRACT

Apparatus is described for rolling flat hose or strip material upon itself to form a roll. The apparatus includes an elongated frame and a crank rotatably connected to the frame. An arm extending from the crank toward the frame grasps the hose or strip while the crank is rotated. The apparatus is portable and collapsible.

16 Claims, 5 Drawing Sheets

HOSE ROLLING APPARATUS

FIELD OF THE INVENTION

This invention relates to apparatus for rolling elongated hoses into a roll. More particularly, this invention relates to apparatus for rolling flat hoses (e.g., fire hoses).

BACKGROUND OF THE INVENTION

The rolling or coiling of hoses can be a time consuming process. This is especially true for fire hoses which must be re-coiled after each use.

Typically, fire hoses are about fifty feet in length. Each end of such a hose includes a coupling which enables the hoses to be connected to each other in end-to-end fashion. This enables any desired number of hoses to be connected together to carry water from a fire hydrant or fire truck to a fire to be fought.

Although the hoses can be rolled manually into rolls after they have been used, this is a slow and labor intensive procedure. Also, it is difficult to wind the hose tightly when doing it manually.

There have been proposed different types of spools for winding fire hoses, but such devices have not been very successful. Some fire trucks may include powered hose winders, but such equipment is not portable and isn't of any use for rolling hoses at locations away from the fire truck (e.g., in the forest). Also, powered hose winders are expensive.

There has not heretofore been provided apparatus for simple and efficient coiling or winding of flat hoses (e.g., fire hoses) or other flat strip material.

SUMMARY OF THE PRESENT INVENTION

In accordance with the present invention there is provided hose rolling apparatus for rolling flat hose or other flat strip material upon itself to form a roll. In a preferred embodiment the apparatus comprises:

(a) an elongated frame member having first and second ends;

(b) attachment means carried by the frame member for securing the frame member to an upright support (e.g., the side of a truck, a tree, a wall, etc.);

(c) an elongated crank member having first and second ends; wherein the crank includes a shank projecting away therefrom (preferably at a right angle); wherein the crank is rotatably and detachably connected to the frame member by means of the shank;

(d) an arm carried by the first end of the crank for gripping the hose and retaining it when the crank is rotated, whereby the hose is rolled upon itself to form a roll.

The apparatus of the invention is portable and light in weight so that it can be easily carried or transported to any desired location for use. It can be quickly attached or secured to any desired upright support surface (e.g., a fire truck, a tree, post, or other suitable support).

After the hose(s) has been wound into a roll it can be easily removed from the apparatus for storage. No spools or other associated equipment are required.

The apparatus can accommodate hoses or flat strip material of various widths and lengths. The apparatus is easily operated, and the hose is coiled in such a manner that it is retained in the coiled form and ready for use when needed. The hose or strip material may be wound from one end, or from the center, or from any other point between its ends, as desired. The hose can also be wound by rotating the crank in either direction.

Other advantages and features of the apparatus of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
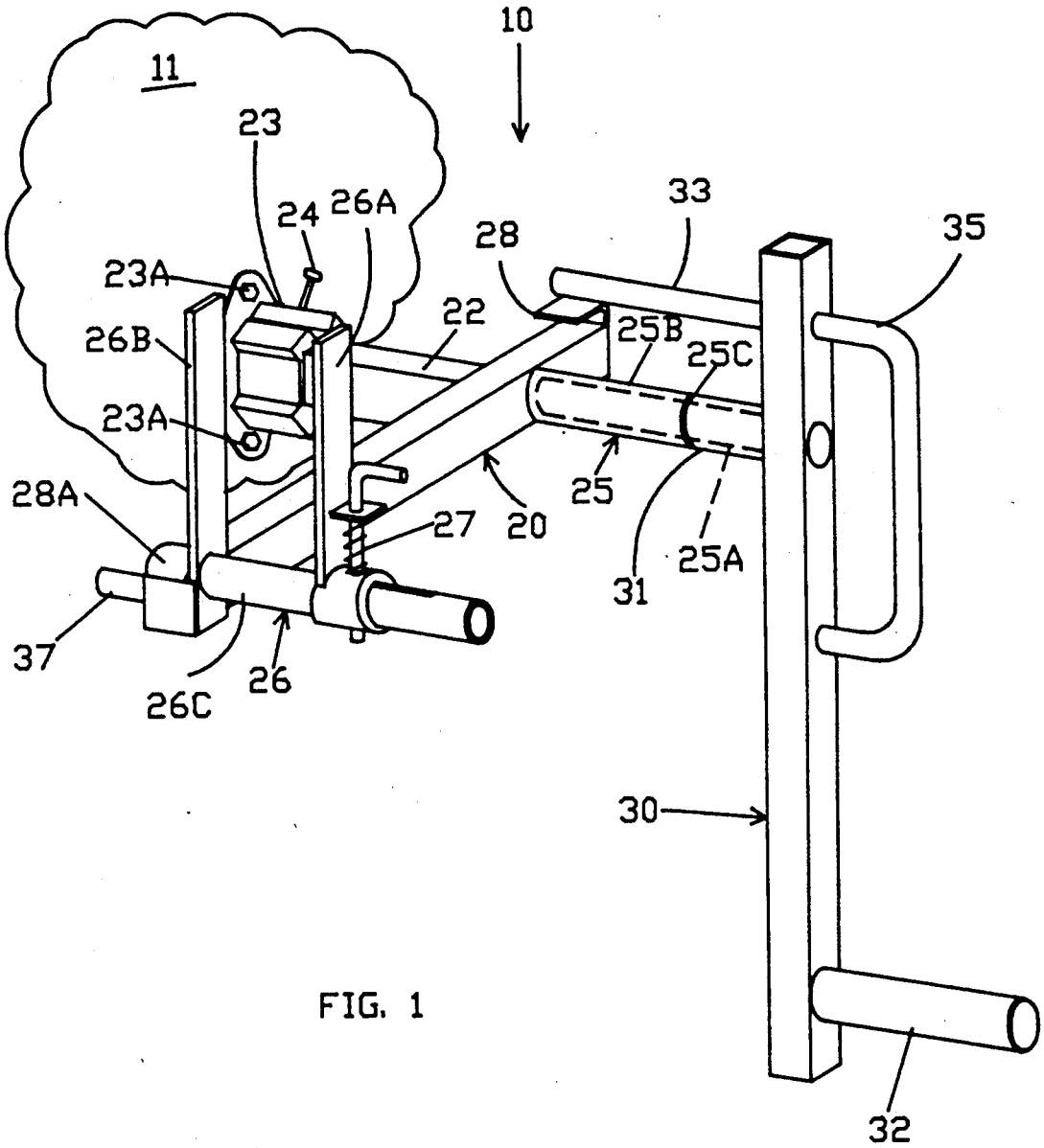
FIG. 1 is a perspective view showing a preferred embodiment of hose rolling apparatus of the invention.

In the drawings there is shown hose rolling apparatus 10 comprising an elongated frame member 20 and an elongated crank member 30. The frame 20 may be detachably secured to upright support surface 11 (e.g., a truck) by means of arm 22 and clamp or bracket 23.

The bracket may be secured to surface 11 by means of threaded bolts 23A, for example. The outer end of arm 22 is slidably received in bracket 23 and may be retained therein by means of bolt 24.

Near one end of frame 20 there is an arm 25 which extends outwardly, preferably at a right angle to frame 20. The arm 25 comprises a post 25A for rotatable attachment of the crank member 30. Preferably a sleeve member 25B surrounds the inner end of post 25A, as illustrated. The sleeve 25B has a slightly larger diameter than post 25A and is freely rotatable relative to post 25A.

The crank arm 30 preferably is an elongated member which includes a tubular shank 31 for slidably and rotatably engaging the outer end of post 25A. Thus, crank 30 is freely rotatable about post 25A. At the outer end of crank 30 there is a handle 32 which is gripped by the operator when rotating the crank about post 25A. Collar 25C is fastened to post 25A to serve as a retainer member to prevent sleeve 25B from sliding outwardly. The collar does not prevent sleeve 25B from freely rotating on post 25A, however.

At or near the inner end of crank 30 there is an arm 33 which extends toward frame 20. Preferably arm 33 is perpendicular to crank 30 and parallel to arm 25, as illustrated. The spacing between arm 33 and arm 25 is such that the end of the flat hose or strip material will fit between the two arms, and the coupling at the end of the hose is too large to pass between the two arms.

Figure 2:
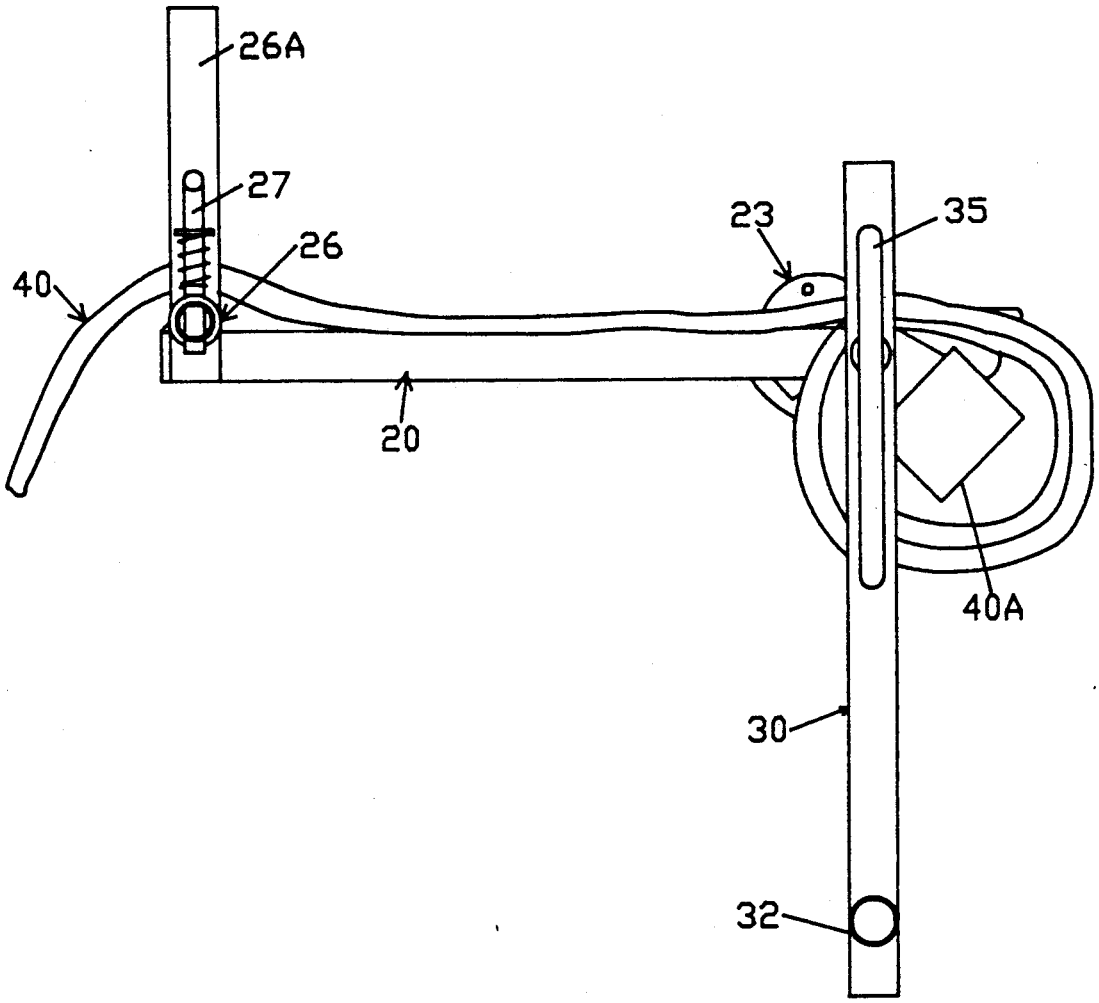
FIG. 2 is a side elevational view illustrating the manner in which a flat hose is wound into a coil using the apparatus of FIG. 1.

In FIG. 2 there is shown a side elevational view of the hose rolling apparatus in which a hose 40 is being rolled into a coil by use of the apparatus. The end of the hose includes a large coupling 40A which is larger in diameter than the spacing between arm 25 and arm 33.

Thus, as the crank is rotated about post 25A, the end 40A of the hose 40 is retained by arms 25 and 33. Accordingly, the hose is coiled around arm 25 and arm 33 as the crank is rotated. The crank may be rotated either clockwise or counter-clockwise to coil a hose or strip.

When rolling conventional fire hose, the spacing between arms 25 and 33 is generally about 2 to 3 inches. The couplings used on fire hoses typically have a diameter greater than about 2 to 3 inches. Thus, the coupling on the end of the hose is too large to pass between the two arms. Of course, if desired, the spacing between such two arms could be made differently so as to accommodate hoses having different sizes of couplings. It is also possible to connect arm 33 to crank 30 in such a manner that the spacing between arms 33 and 25 can be selectively adjusted, as desired.

Instead of arm 33 being perpendicular to crank 30, it could be mounted at a different angle, if desired. Indeed, arm 33 could be of any desired configuration so long as it is capable of retaining the hose or other strip material to be rolled.

At the outer end of the frame 20 there is a guide 26 for guiding the hose or strip material as it is being wound into a roll. As illustrated, the guide means is U-shaped and includes upright members 26A and 26B. Preferably the upright member 26A is width adjustable on arm 26C so as to accommodate hoses of different widths. For example, upright 26A may be detachably secured to arm 26C by means of a spring-biased pin 27, thereby enabling upright 26A to be moved along arm 26C as desired.

Preferably the upright members 26A and 26B are adapted to be rotated 90° relative to the elongated arm of frame 20 for storage or transport purposes. For example, the lower end of upright 26B may be mounted to frame 20 by means of a spring loaded pin 37 which enables arm 26C to be pulled slightly away from frame 20 and then rotated 90°. Since arm 26 is attached to upright 26B, both uprights move together so as to become aligned in the same plane as frame 20.

The length of the elongated frame 20 may vary, as desired. Normally the length is in the range of about 12 to 24 inches. The length of crank 30 may also vary, e.g., from about 12 to 24 inches. Other lengths could also be used, if desired.

After the hose has been coiled around arms 25 and 33, the crank 30 is easily slid outwardly to disengage it from the post 25A. Then the coiled hose can be removed for storage.

Instead of coiling a hose or other strip material from one end, it is possible to simply fold one end of the hose or strip material back upon itself and then hook it over arm 33. For example, if a hose is doubled upon itself, then the loop can be hooked onto arm 33 so that when the hose is rolled up into a coil, both ends of the hose are accessible on the outside of the coil. This is sometimes referred to as a dutch roll. The advantage of this method of rolling a hose is that several rolled hoses can be connected together prior to unrolling.

Figure 3:
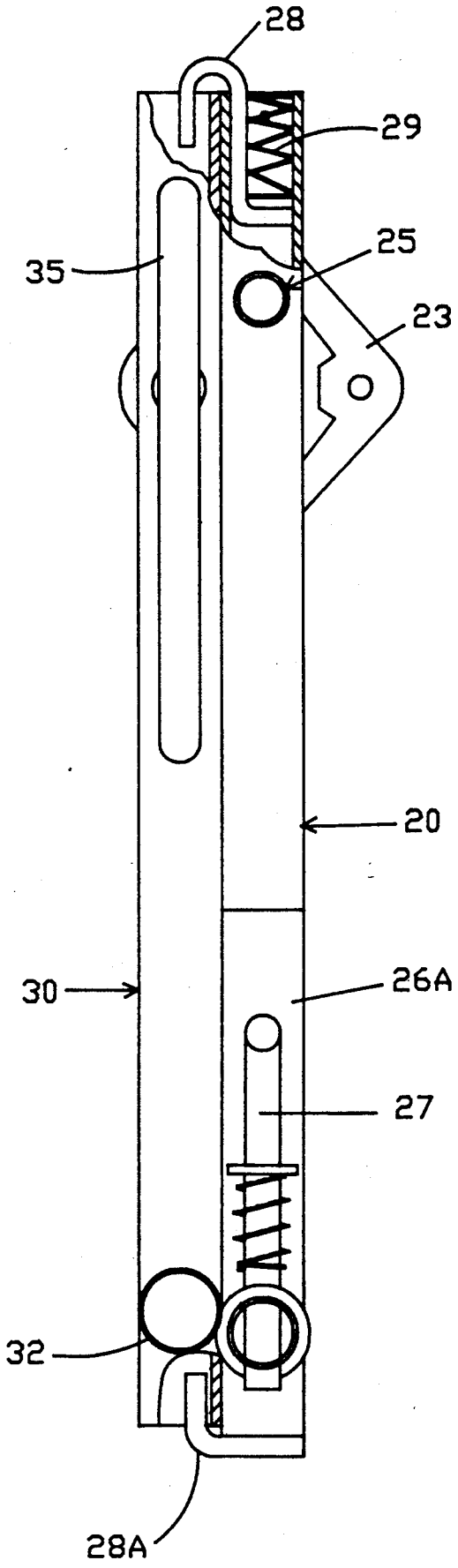
FIG. 3 is a side view illustrating one manner in which the apparatus of FIG. 1 can be collapsed into two separate pieces and fastened together for storage and transport.

As illustrated in FIG. 3, the crank 30 can be temporarily and detachably connected to frame 20 for transport or storage, if desired. Clip members 28 and 28A carried by frame 20 serve to grasp opposite ends of crank 30 and secure the crank to the frame. Preferably clip member 28 is adapted to be extended outwardly (against a spring bias 29, for example) to facilitate connection to the crank 30, as illustrated. Then the collapsed apparatus can be conveniently carried by handle 35. The apparatus can also be easily suspended from a hanger, etc. by means of handle 35.

Figure 4:
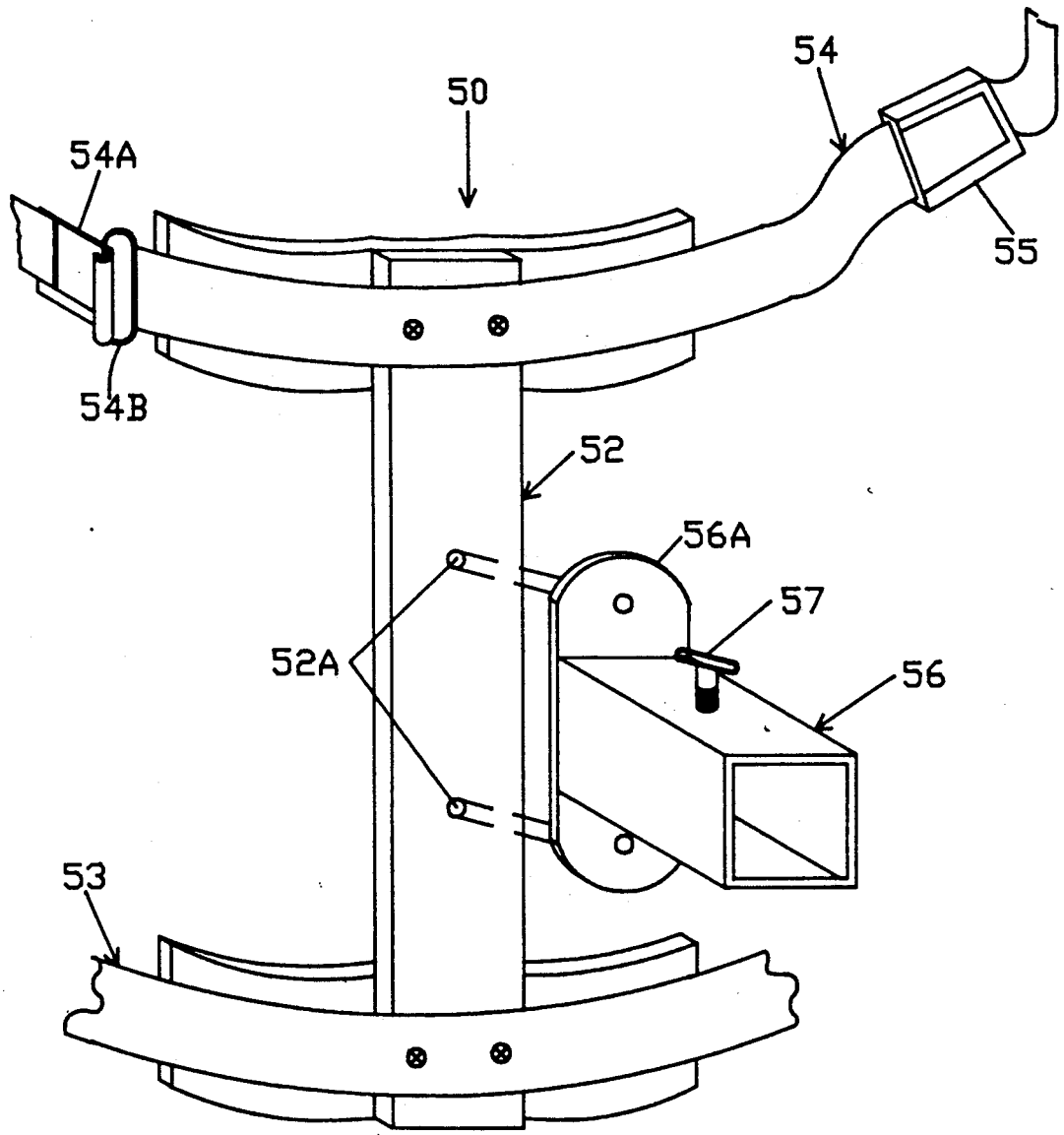
FIG. 4 is a perspective view illustrating one manner in which the apparatus can be mounted to a tree, post, etc.

FIG. 4 is a perspective view illustrating a useful attachment means 50 for securing the hose rolling apparatus to an upright support such as a tree, post, or the like. The attachment means includes a relatively rigid or sturdy frame 52 having upper and lower ends. A flexible strap 54 is secured to the upper end of the frame and a flexible strap 53 is secured to the lower end. Each strap preferably includes a hook (such as is illustrated by 54A) which detachably engages a ring 54B, as shown. The hook and ring arrangement enables the strap to be quickly and easily extended around a tree, post, etc. and then re-connected. A slip buckle 55 enables the strap to be tightened to hold the frame securely to the upright support.

Bracket 56 is adapted to be bolted at end 56A to the upright section of the frame 52. Holes 52A in frame 52 can accommodate the bolts used for this purpose. Threaded bolt 57 is for detachably securing arm 22 of the hose rolling apparatus shown in FIG. 1.

Figure 5:
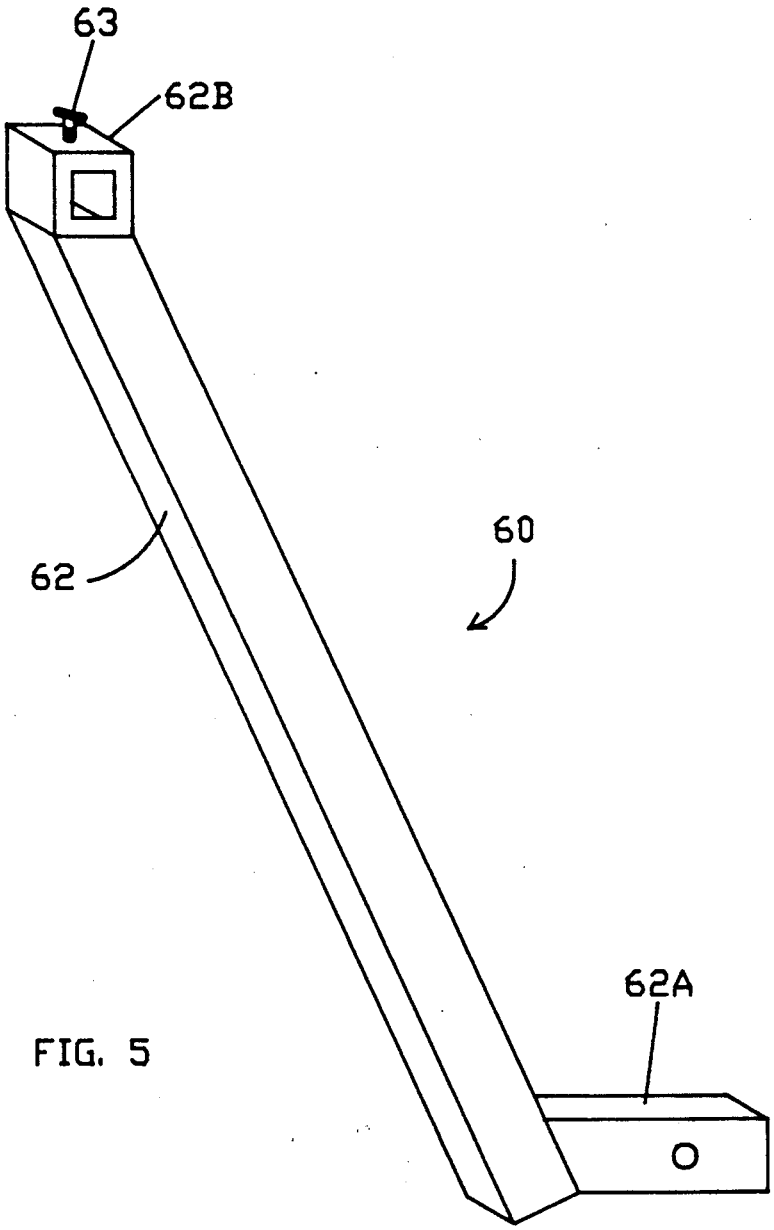
FIG. 5 is a perspective view illustrating support means for mounting the apparatus to a trailer hitch.

FIG. 5 illustrates another type of attachment or support means 60 for supporting the hose rolling apparatus using a conventional receiver hitch on a truck. Support 60 includes a lower end 62A which is adapted to be slidably engaged in a conventional tubular hitch receiver where it can be retained by means of a conventional pin.

Elongated upright 62 extends upwardly and carries a tubular receiver bracket 62B at its upper end. Arm 22 of the hose rolling apparatus can be slidably received in bracket 62B and then held in place by means of threaded bolt 63.

Thus, the hose rolling apparatus of this invention can be used anywhere for rolling flat hose (e.g., fire hose) or other flat strip material. The apparatus can be collapsed for transport and storage.

Other variants are possible without departing from the scope of this invention.

What is claimed is:

1. Hose rolling apparatus for rolling a flat hose upon itself, said apparatus comprising:

(a) an elongated frame member having first and second ends; wherein said frame member includes a post member projecting outwardly therefrom at a right angle;

(b) attachment means carried by said frame member for securing said frame member to an upright support;

(c) an elongated crank member having first and second ends; wherein said crank member includes a tubular shank projecting away therefrom; wherein said crank is rotatably and detachably connected to said frame member by means of said shank slidably and rotatably engaging said post member;

(d) an arm member carried by said first end of said crank member; wherein said arm member is adapted to grip said hose and retain it when said crank is rotated, whereby said hose is rolled upon itself to form a roll.

2. Apparatus in accordance with claim 1, wherein said shank is parallel to said arm member; and wherein said shank is perpendicular to said crank member.

3. Apparatus in accordance with claim 1, further comprising guide means carried by said second end of said frame member.

4. Apparatus in accordance with claim 3, wherein said guide means comprises a U-shaped member.

5. Apparatus in accordance with claim 4, wherein said U-shaped member is width-adjustable.

6. Apparatus in accordance with claim 1, further comprising a sleeve member rotatably carried by said post member.

7. Apparatus in accordance with claim 1, further comprising connection means for connecting said frame member and said crank member together for storage.

8. Apparatus for rolling a length of flat hose upon itself, said apparatus comprising:

(a) an elongated frame member having first and second ends; wherein said frame member includes a post member projecting outwardly therefrom at a right angle;

(b) guide means carried by said second end of said frame member;

(c) attachment means carried by said frame member for securing said frame member to an upright support;

(d) an elongated crank member having first and second ends; wherein said crank member includes a tubular shank projecting outwardly therefrom; wherein said crank is rotatably and detachably connected to said frame member by means of said shank slidably and rotatably engaging said post member; wherein said shank is perpendicular to said crank member;

(e) an arm member carried by said first end of said crank member;

wherein said arm member is adapted to grip said hose and retain it when said crank is rotated, whereby said hose is rolled upon itself to form a roll.

9. Apparatus in accordance with claim 8, wherein said guide means comprises a U-shaped member.

10. Apparatus in accordance with claim 9, wherein said U-shaped member is width-adjustable.

11. Apparatus in accordance with claim 8, further comprising a sleeve member rotatably carried by said post member.

12. Apparatus in accordance with claim 8, further comprising connection means for connecting said frame member and said crank member together for storage.

13. Apparatus for rolling a length of flat strip material upon itself, said apparatus comprising:

(a) an elongated frame member having first and second ends; wherein said frame member further includes a post member projecting outwardly therefrom at a right angle;

(b) U-shaped guide means carried by said second end of said frame member;

(c) attachment means carried by said frame member for securing said frame member to an upright support;

(d) an elongated crank member having first and second ends; wherein said crank member includes a shank projecting outwardly therefrom; wherein said crank is rotatably and detachably connected to said frame member by means of said shank; wherein said shank is perpendicular to said crank member; wherein said shank is tubular;

(e) an arm member carried by said first end of said crank member; wherein said arm member is perpendicular to said crank member;

wherein shank is adapted to slidably and rotatably engage said post member; wherein said arm member is adapted to grip said strip material and retain it when said crank is rotated, whereby said strip material is rolled upon itself to form a roll.

14. Apparatus in accordance with claim 13, further comprising a sleeve member rotatably carried by said post member.

15. Apparatus in accordance with claim 13, further comprising connection means for connecting said frame member and said crank member together for storage.

16. Apparatus in accordance with claim 15, further comprising a handle member secured to said crank member for carrying said apparatus.

* * * * *